US012607024B2

(12) United States Patent
Liao

(10) Patent No.: US 12,607,024 B2
(45) **Date of Patent: *Apr. 21, 2026**

(54) TILE LEVELER

(71) Applicant: Hui-Chuan Liao, Oakland, CA (US)

(72) Inventor: Hui-Chuan Liao, Oakland, CA (US)

( * ) Notice: Subject to any disclaimer, the term of this patent is extended or adjusted under 35 U.S.C. 154(b) by 135 days.

This patent is subject to a terminal disclaimer.

(21) Appl. No.: 18/664,337

(22) Filed: May 15, 2024

(65) Prior Publication Data

US 2025/0354393 A1 Nov. 20, 2025

(51) Int. Cl.

| | |
|---|---|
| ***E04F 21/18*** | (2006.01) |
| ***E04F 13/08*** | (2006.01) |
| ***E04F 15/02*** | (2006.01) |
| ***E04F 21/22*** | (2006.01) |

(52) U.S. Cl.

CPC ..... *E04F 21/1877* (2013.01); *E04F 13/0892* (2013.01); *E04F 15/02005* (2013.01); *E04F 21/22* (2013.01)

(58) Field of Classification Search

CPC ..... E04F 13/0892; E04F 15/02005; E04F 21/0092; E04F 21/22; E04F 21/1877

See application file for complete search history.

(56) References Cited

U.S. PATENT DOCUMENTS

| | | | | |
|---|---|---|---|---|
| 8,291,665 | B2 * | 10/2012 | Sondermann | E04F 19/065 52/459 |
| 9,279,259 | B1 * | 3/2016 | Russo | E04F 21/0092 |
| 9,322,185 | B1 * | 4/2016 | Russo | E04F 21/0092 |
| 9,482,019 | B2 * | 11/2016 | Fontana | E04F 21/22 |
| 10,053,872 | B2 * | 8/2018 | Sighinolfi | E04F 21/0092 |
| D834,922 | S * | 12/2018 | Russo | D8/355 |
| 10,538,925 | B2 * | 1/2020 | Ghelfi | E04F 13/0892 |
| 10,577,813 | B2 * | 3/2020 | Dahill | E04F 21/22 |
| 10,760,284 | B2 * | 9/2020 | Bordin | E04F 13/0862 |
| 10,801,218 | B2 * | 10/2020 | Cipriani | E04F 15/02022 |
| D911,821 | S * | 3/2021 | Troxell | D8/354 |
| 11,002,025 | B2 * | 5/2021 | Sighinolfi | E04F 15/02022 |
| 11,428,019 | B2 * | 8/2022 | Sighinolfi | E04F 21/0092 |
| 11,680,417 | B2 * | 6/2023 | Quesada Barbero | E04F 21/0092 52/126.5 |
| 11,840,852 | B1 * | 12/2023 | Toca | E04F 21/0092 |
| 12,209,420 | B2 * | 1/2025 | Cipriani | E04F 21/0092 |
| 12,435,526 | B2 * | 10/2025 | Pytlewski | E04F 21/1877 |
| 2015/0354231 | A1 * | 12/2015 | Bordin | E04F 21/0092 52/126.6 |

(Continued)

FOREIGN PATENT DOCUMENTS

| | | | | |
|---|---|---|---|---|
| GB | 2234995 A * | 2/1991 | | E04F 19/062 |
| WO | WO-2016189423 A1 * | 12/2016 | | E04F 21/20 |
| WO | WO-2023148596 A1 * | 8/2023 | | E04F 21/22 |

*Primary Examiner* — Jessie T Fonseca

(74) *Attorney, Agent, or Firm* — WPAT, PC

(57) ABSTRACT

A tile leveler has a base and a spin cover. The base has a clamping board, a connecting slice, and a connecting rod. The spin cover is detachably connected to the base, is a transparent cover, and has a screw portion and a spin portion. The screw portion is disposed on a top of the spin cover and is connected to the connecting rod. The spin portion is connected to the screw portion and has at least one rotating strip. Each one of the at least one rotating strip has an abutted-curved face disposed on an outer side of the rotating strip away from the screw portion.

16 Claims, 11 Drawing Sheets

(56) References Cited

U.S. PATENT DOCUMENTS

| | | | | |
|---|---|---|---|---|
| 2018/0148939 | A1* | 5/2018 | Sighinolfi | E04F 21/0092 |
| 2019/0093372 | A1* | 3/2019 | Russo | E04F 21/20 |
| 2019/0127994 | A1* | 5/2019 | Cipriani | E04F 21/0092 |
| 2019/0242143 | A1* | 8/2019 | Dahill | E04F 21/22 |
| 2019/0271167 | A1* | 9/2019 | Ghelfi | E04F 21/0092 |
| 2020/0149296 | A1* | 5/2020 | Bedrosian | E04F 21/0092 |
| 2022/0154475 | A1* | 5/2022 | Sighinolfi | E04F 21/1877 |
| 2022/0298807 | A1* | 9/2022 | Pytlewski | E04F 21/0092 |
| 2022/0372772 | A1* | 11/2022 | Quesada Barbero | E04F 21/1877 |
| 2023/0091132 | A1* | 3/2023 | Caruso | E04F 21/0092<br>52/126.5 |
| 2023/0228105 | A1* | 7/2023 | Cipriani | E04F 21/0092<br>52/126.5 |

* cited by examiner

TILE LEVELER

BACKGROUND OF THE INVENTION

1. Field of the Invention

The present invention relates to a leveler, and more particularly to a tile leveler that is easy to observe and operate.

2. Description of Related Art

In order to ensure that tiles can remain flat without unevenness when attached to the floor or wall, a tile leveler is generally used during the process of attaching the tiles. After two adjacent tiles are clamped and pressed by the leveler, it is ensured that the two adjacent tiles are held at a consistent height and position. With reference to FIG. 10, a conventional tile leveler 80 has a base 81 and a spin cover 82. The base 81 has a clamping board 811, a connecting slice 812, and a connecting rod 813. The connecting slice 812 is connected to the clamping board 811 and the connecting rod 813. The spin cover 82 is rotatably connected to the connecting rod 813 of the base 81 to hold and clamp the two adjacent tiles between the base 81 and the spin cover 82, and has multiple ribs 83 disposed at spaced intervals in a middle section of the spin cover 82. Each one of the ribs 83 is a straight strip-shaped body and is disposed inclined on the middle section of the spin cover 82. In use, fingers of a user press against the ribs 83, rotate the spin cover 82 relative to the base 81, and then adjust a distance between the spin cover 82 and the base 81, thereby performing a clamping operation on the two adjacent tiles.

However, the conventional tile leveler 80 can provide a leveling effect of clamping and pressing two adjacent tiles. With reference to FIG. 11, when the user rotates the spin cover 82 of the conventional tile leveler 80, since the clamping board 811 of the base 80 is disposed below the two tiles and the spin cover 82 is not a transparent cover, the user may be blocked by the spin cover 80 and cannot see or observe to clearly know the distance between the spin cover 82 and the clamping board 811. The user only can confirm the distance between the spin cover 82 and the clamping board 811 when the spin cover 82 is in contact with the two adjacent tiles. Furthermore, the user cannot directly observe whether the two adjacent tiles have reached a flat state via the spin cover 82, only can observe the flatness of the two adjacent tiles through intervals between the ribs 83 during the rotation of the spin cover 82, and this is relatively inconvenient and time-consuming in use.

In addition, with reference to FIG. 11, when the user rotates the spin cover 82 of the conventional leveler 80, since each one of the ribs 83 of the spin cover 82 is a straight strip, the user's curved fingers cannot abut the ribs firmly and closely, and it is easy to form gaps between the user's fingers and the corresponding ribs 83. Then the user cannot conveniently hold and rotate the spin cover 82 and must apply additional force to hold and rotate the spin cover 82 relative to the base 81, and this is relatively inconvenient and laborious. Therefore, according to the above-mentioned problems and deficiencies, the conventional tile leveler 80 needs to be improved.

The tile leveler in accordance with the present invention mitigates or obviates the aforementioned problems.

SUMMARY OF THE INVENTION

The main objective of the present invention is to provide a tile leveler that is easy to observe and operate.

The tile leveler in accordance with the present invention has a base and a spin cover. The base has a clamping board, a connecting slice, and a connecting rod. The spin cover is detachably connected to the base, is a transparent cover, and has a screw portion and a spin portion. The screw portion is disposed on a top of the spin cover and is connected to the connecting rod. The spin portion is connected to the screw portion and has at least one rotating strip. Each one of the at least one rotating strip has an abutted-curved face disposed on an outer side of the rotating strip away from the screw portion.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1 to 5, a tile leveler in accordance with the present invention has a base 10 and a spin cover 20.

Figure 2:
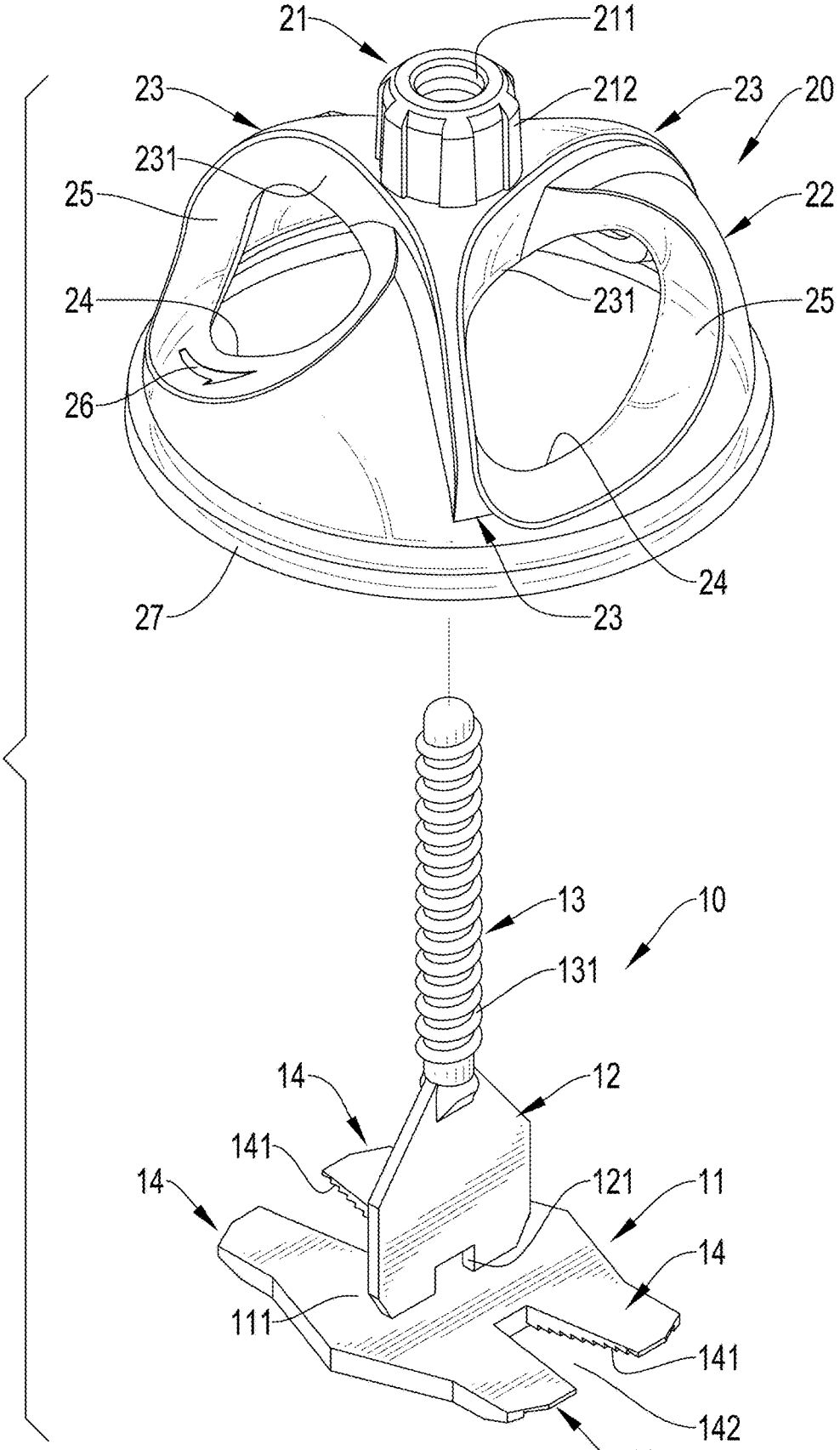
FIG. 2 is an exploded perspective view of the tile leveler in FIG. 1.
Figure 3:
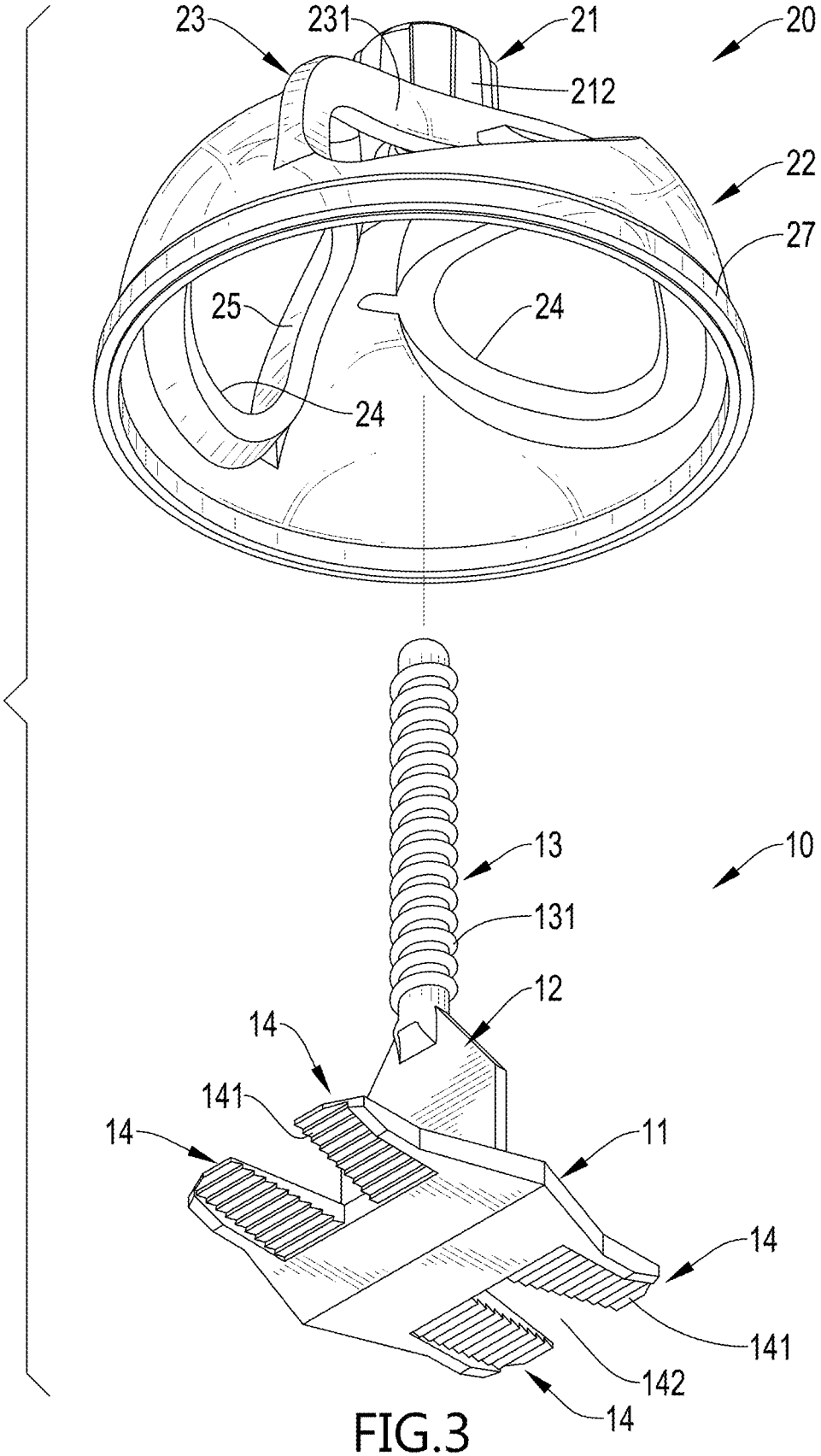
FIG. 3 is another exploded perspective view of the tile leveler in FIG. 1.

With reference to FIGS. 2 and 3, the base 10 has a clamping board 11, a connecting slice 12, and a connecting rod 13. The clamping board 11 has a clamping face 111 being flat and disposed on a top side of the clamping board 11. Furthermore, the clamping board 11 has at least one clamping portion 14 disposed on each one of two ends of the clamping board 11. Each one of the at least one clamping portion 14 has multiple abutted teeth 141 arranged in a stepped manner on a bottom surface of the clamping portion 14, and this can increase the contact area and friction between the clamping board 11 and adhesion fluids such as cement to dispose the clamping board 11 firmly on the cement. Preferably, the clamping board 11 has two said clamping portions 14 disposed on each one of the two ends of the clamping board 11 at a spaced interval to form a gap 142 between the two said clamping portions 14 and gradually expanded from the inside to the outside.

The connecting slice 12 is connected to the clamping face 111 of the clamping board 11 between the said clamping portions 14, is extended upwardly from the top side of the clamping board 11, and has a through hole 121. The through hole 121 is formed through the connecting slice 12 between the clamping board 11 and the connecting slice 12. The connecting slice 12 can be broken relative to the clamping board 11 via the through hole 121. The connecting rod 13 is connected to an edge of the connecting slice 12 away from the clamping board 11 and has a thread 131 formed on an external surface of the connecting rod 13.

Figure 4:
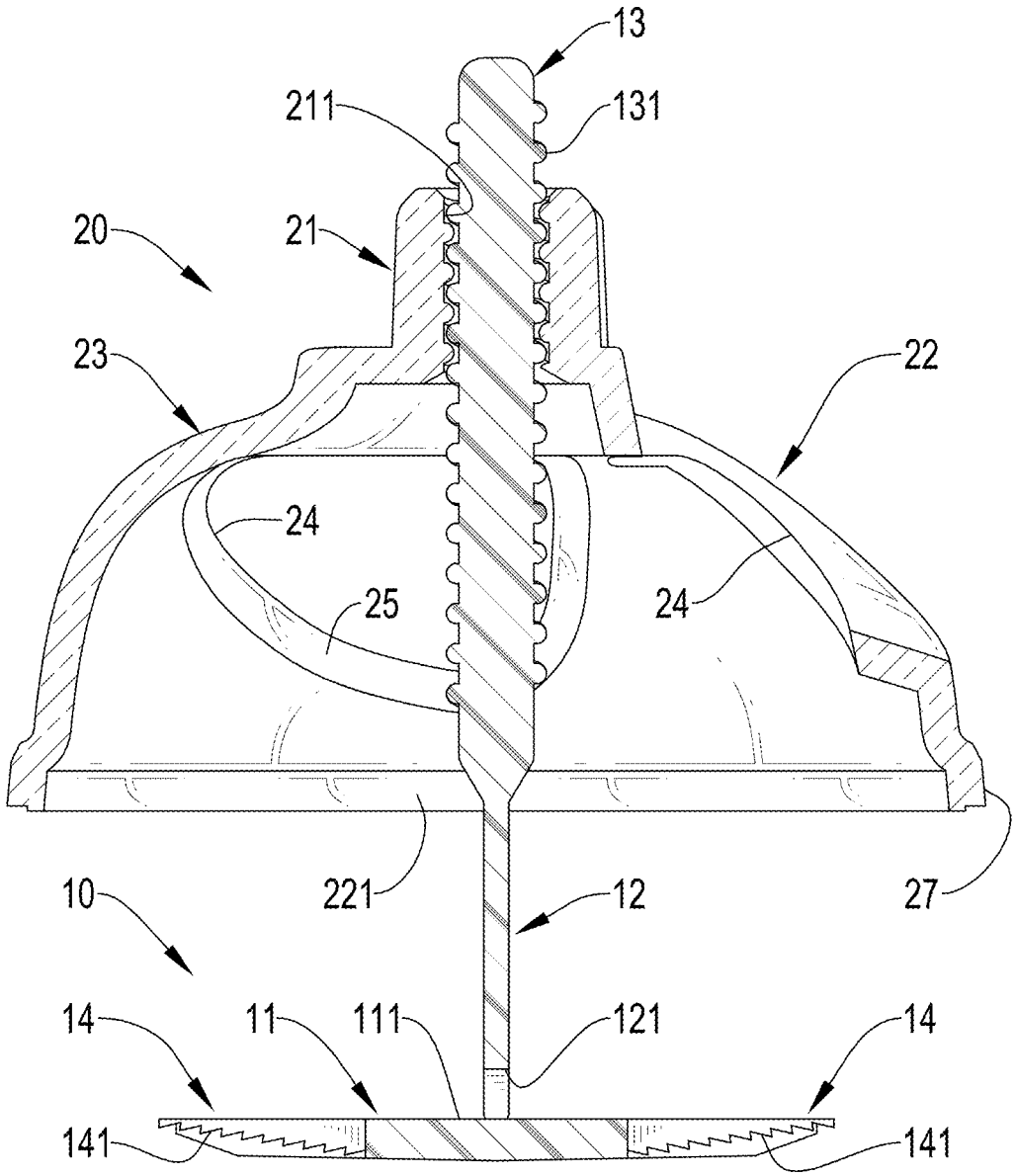
FIG. 4 is a cross-sectional side view of the tile leveler in FIG. 1.

With reference to FIGS. 2 to 4, the spin cover 20 is detachably connected to the base 10 and is a transparent cover made of a transparent material so that the spin cover 20 has light-transmissive properties. The transparent material can be a known material such as Acrylonitrile Butadiene Styrene resin (ABS resin). The ABS resin is a polymer composed of three components: acrylonitrile, butadiene, and styrene. Acrylonitrile has weather resistance and heat resistance, butadiene has impact resistance, and styrene has the characteristics of gloss and good formability, especially good impact resistance from room temperature to minus 40° C. Then the user will not be blocked by the spin cover 20 and can conveniently observe the leveling status of two adjacent tiles via the spin cover 20.

With reference to FIGS. 2 to 4, the spin cover 20 has a screw portion 21 and a spin portion 22. The screw portion 21 is disposed on a top of the spin cover 20, is connected to the connecting rod 13 of the base 10, and has a threaded hole 211 formed through the screw portion 21 and selectively screwed with the thread 131 of the connecting rod 13. Then the spin cover 20 can be moved relative to the base 10 via an engagement between the screw portion 21 and the connecting rod 13. Furthermore, the screw portion 21 has multiple protruded ribs 212 formed on an external surface of the screw portion 21 at spaced intervals for allowing a user to firmly abut against the screw portion 21 to rotate the spin cover 20.

With reference to FIGS. 2 to 4, and 5, the spin portion 22 is connected to the screw portion 21 and has an opening 221 and at least one rotating strip 23. The opening 221 is formed on a bottom of the spin portion 22. The at least one rotating strip 23 is disposed curvedly on and extends out of an external surface of the spin portion 22 along a direction from the screw portion 21 to the opening 221. Each one of the at least one rotating strip 23 has an abutted-curved face 231 disposed on an outer side of the rotating strip 23 away from the screw portion 21. Furthermore, the spin portion 22 of the spin cover 20 has three said rotating strips 23, each one of the three said rotating strips 23 has two ends, one of the two ends of each said rotating strip 23 is connected to the screw portion 21, and the other one of the two ends of each said rotating strip 23 extends radially toward the opening 221. Additionally, with reference to FIG. 5, each two adjacent ones of the three rotating strips 23 are arranged on the spin portion 22 at an included angle of 120 degrees.

Preferably, with reference to FIGS. 1 to 3, and 5, the spin cover 20 has an abutted hole 24 formed through an external surface of the spin cover 20 between each two adjacent ones of the three rotating strips 23 and being a non-circular structure. The spin cover 20 has an auxiliary contact surface 25 disposed between an outer periphery of each abutted hole 24 and each two adjacent rotating strips 23 and connected to the abutted-curved face 231 of one of the two adjacent rotating strips 23. When a user holds the rotating strips 23 to rotate the spin cover 20, the fingers of the user abut the abutted-curved faces 231 and the auxiliary contact surfaces 25, firstly, the contact area between the user's fingers and the spin cover 20 can be increased, so that the spin cover 20 can be rotated stably and firmly. Secondly, with structures of curved design of the rotating strips 23, the abutted-curved faces 231, and the auxiliary contact surfaces 25, the user's fingers can conveniently abut the rotating strips 23 at comfortable angles when holding the spin cover 20, and this can provide an ergonomic structure.

Figure 1:
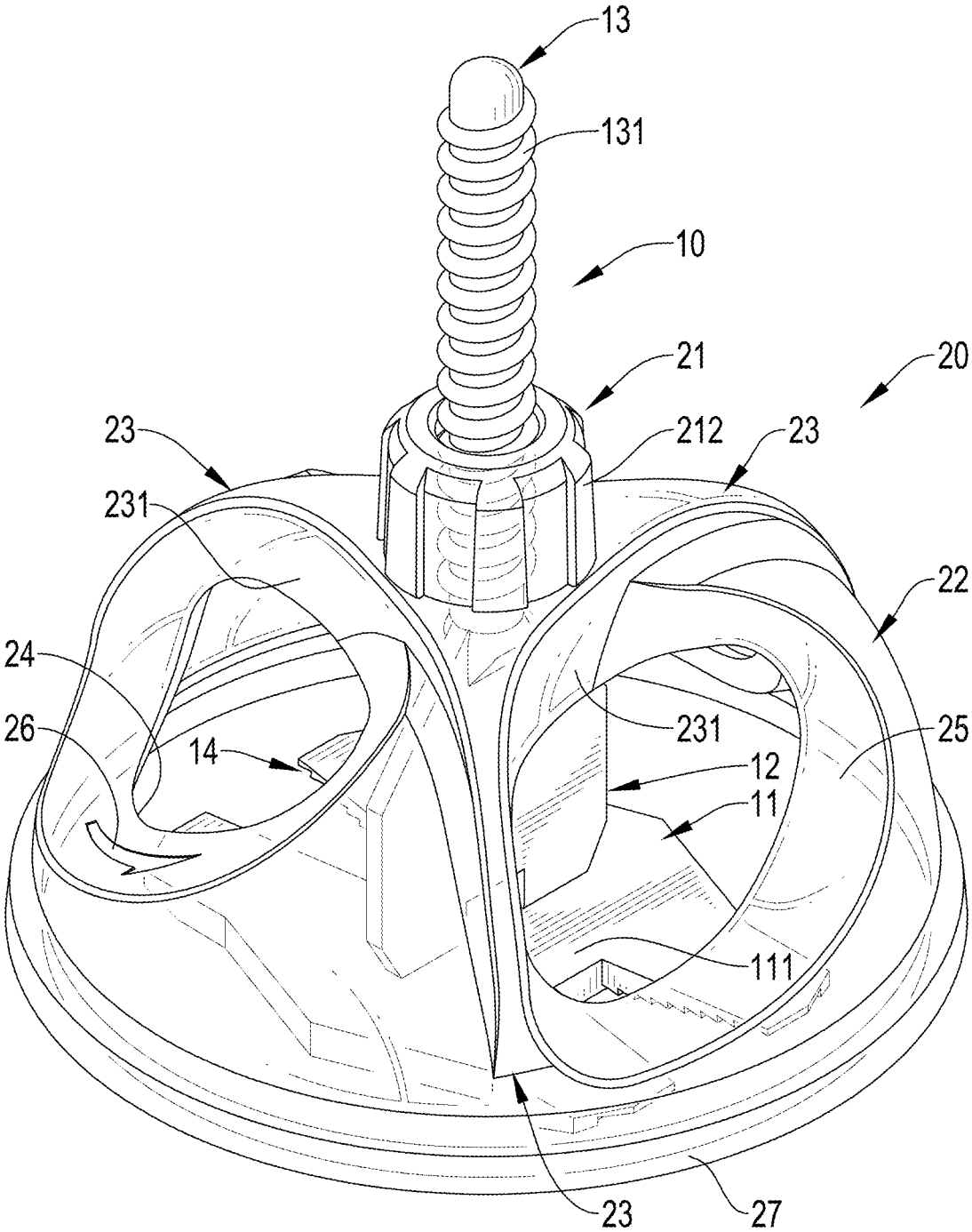
FIG. 1 is a perspective view of a tile leveler in accordance with the present invention.
Figure 5:
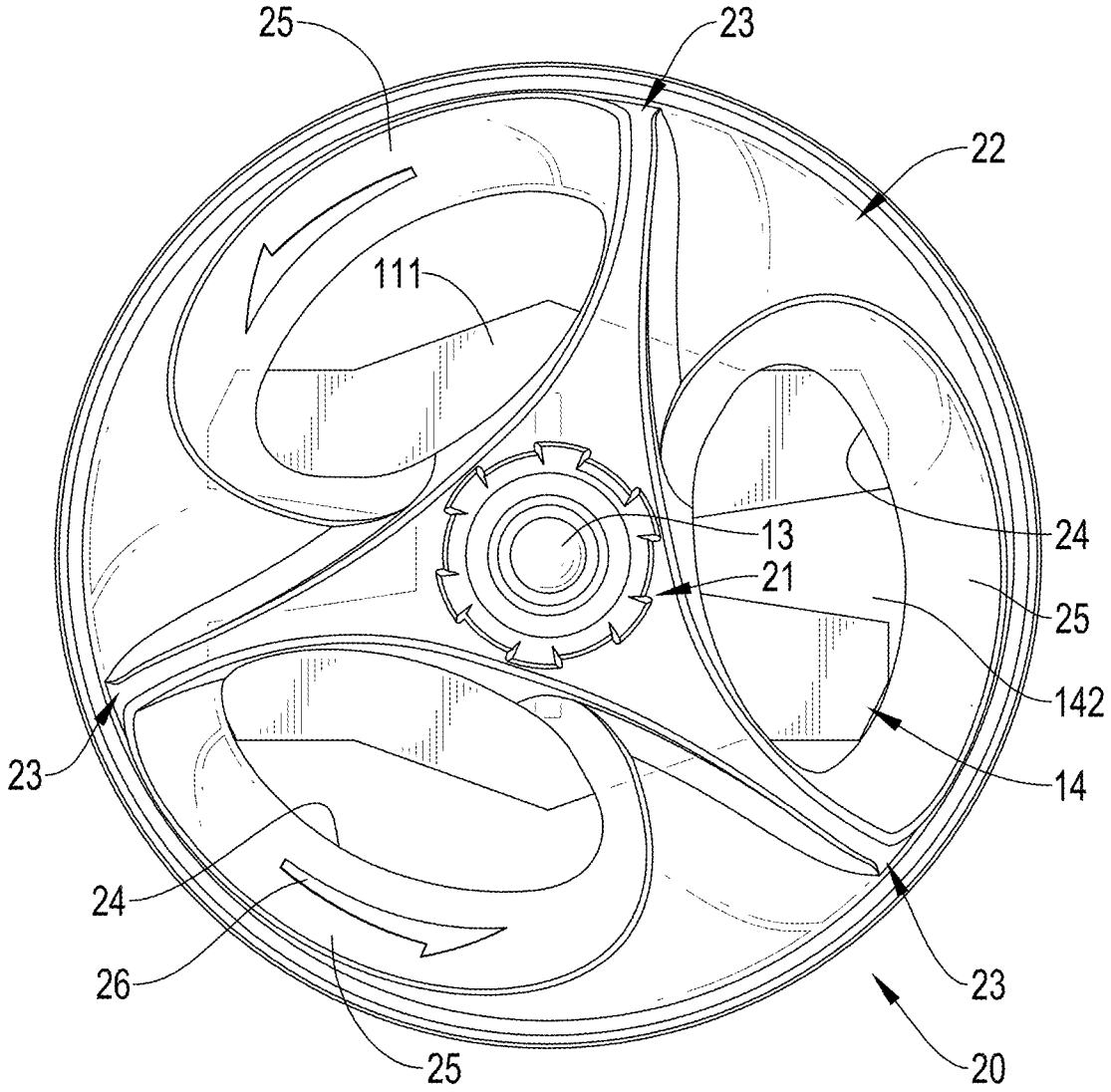
FIG. 5 is a top side view of the tile leveler in FIG. 1.

In addition, with reference to FIGS. 1 and 5, the spin cover 20 has a reminder symbol 26 disposed on at least one of the auxiliary contact surfaces to allow a user to know a rotation direction of the spin cover 20. Furthermore, the spin cover 20 has a pressing flange 27 annularly formed on a bottom of the spin portion 22.

Figure 6:
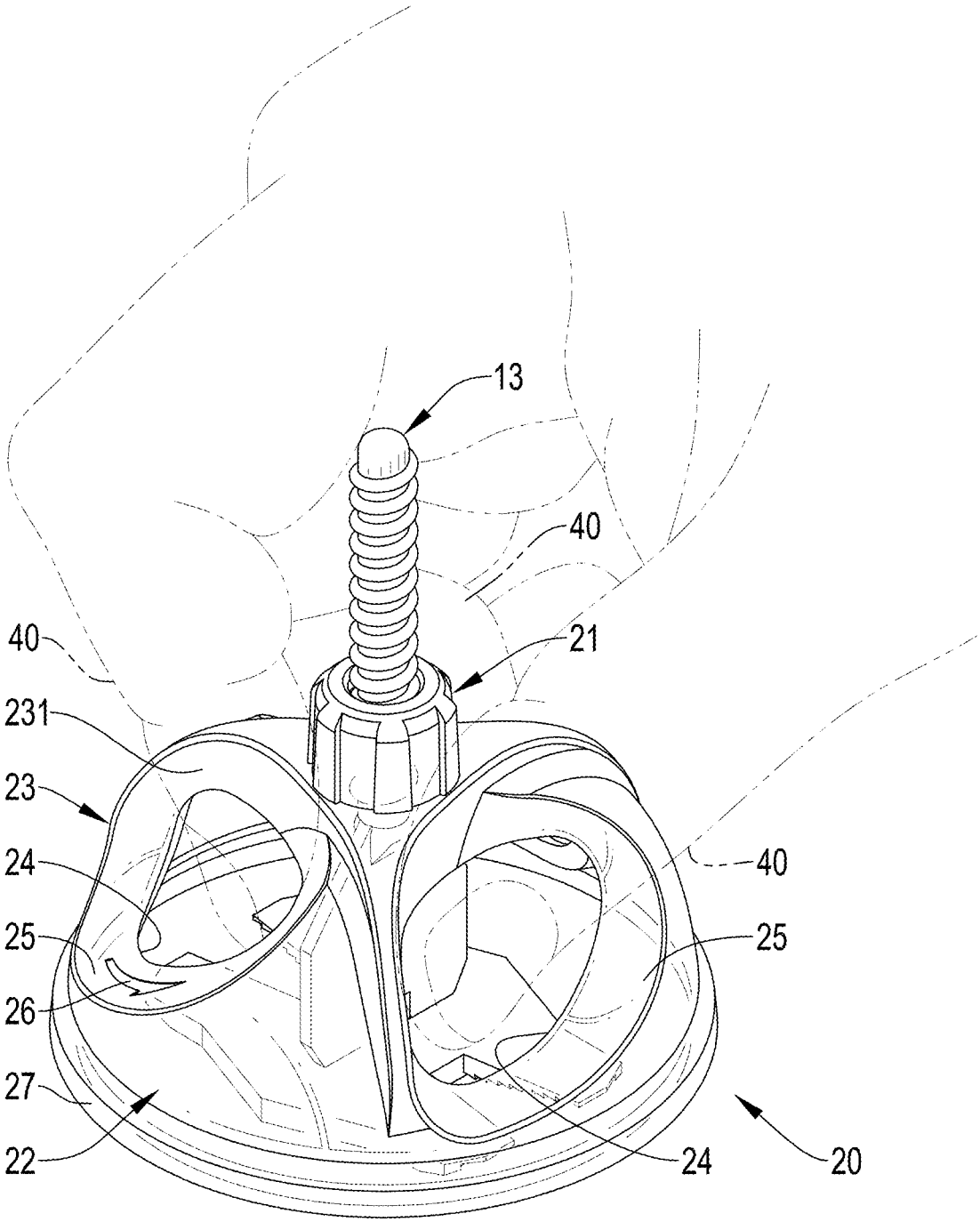
FIG. 6 is an operational perspective view of the tile leveler in FIG. 1.
Figure 7:
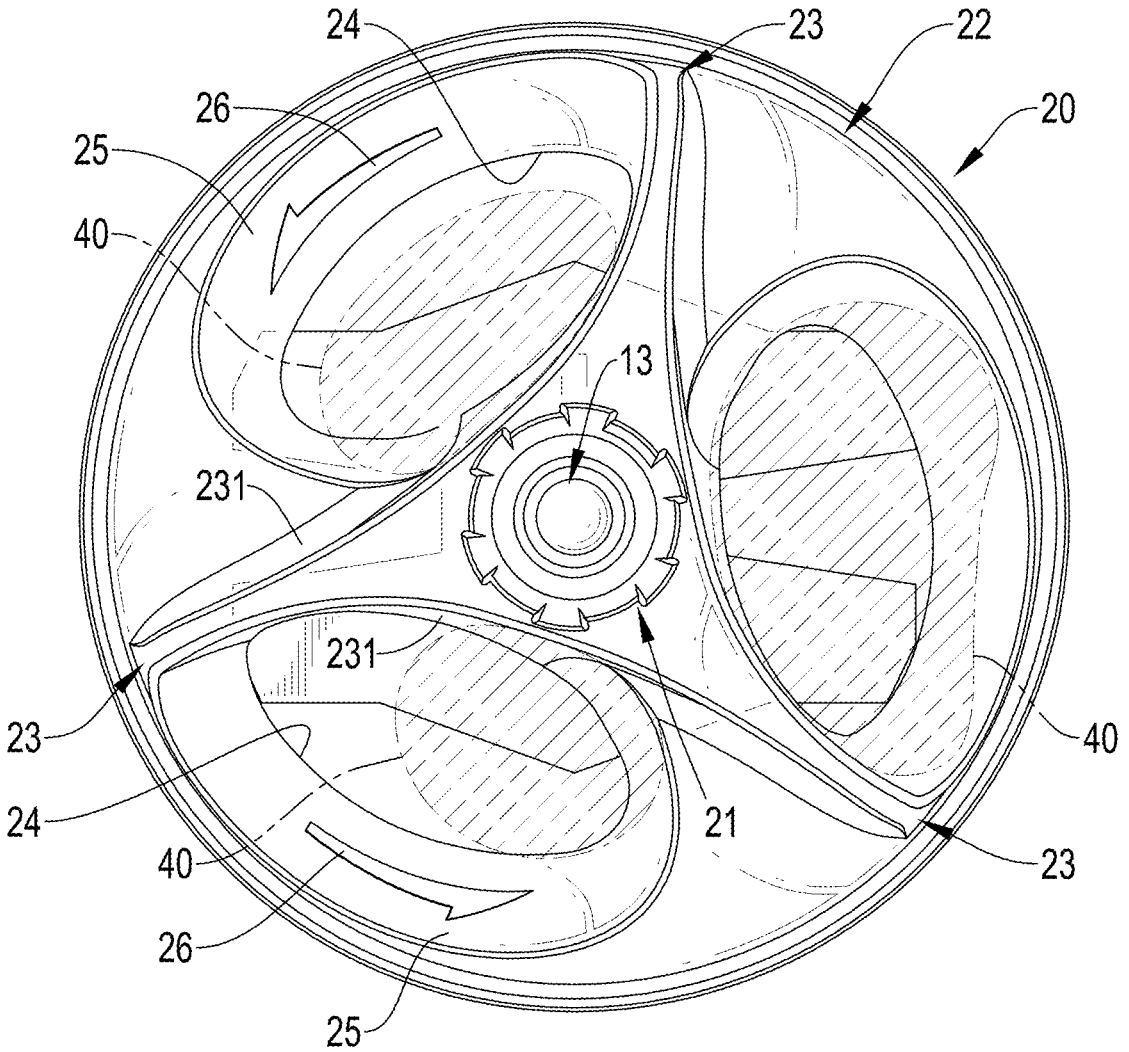
FIG. 7 is an operational top side view of the tile leveler in FIG. 1.

With reference to FIGS. 6 and 7, when the tile leveler of the present invention is in use, the fingers 40 of a user abut the abutted-curved faces 231 of the rotating strips 23 and the auxiliary contact surfaces 25 at the same time, and this can allow the user's fingers 40 to contact the spin cover 20 with a large area, so that the user can contact the spin cover 20 closely without applying additional force and can rotate the spin cover 20 relative to the base 10 conveniently and effortlessly. Furthermore, since the spin cover 20 is a transparent cover, the user can directly observe a distance between the base 10 and the spin cover 20 via the spin cover 20 without blocking by the spin cover 20 to confirm the distance between the clamping board 11 of the base 10 and the spin cover 20, and this is convenient in use.

Additionally, the abutted hole 24 between each two adjacent rotating strips 23 can allow the user's fingers 40 to extend into an interior of the spin cover 20, and can enable each finger 40 to get closer to the corresponding abutted-curved face 231 and the corresponding auxiliary contact surface 25, and this can provide a stable-abutting effect. In addition, the structural arrangement of each rotating strip 23 extended curvedly, each abutted-curved faces 231 being an arc face, and each auxiliary contact surface 25 disposed on the outer periphery of the non-circular abutted hole 24 makes the spin cover 20 ergonomic, and allows the user's fingers 40 to hold the spin cover 20 at a comfortable angle for rotation, thereby providing a labor-saving rotation effect.

Figure 8:
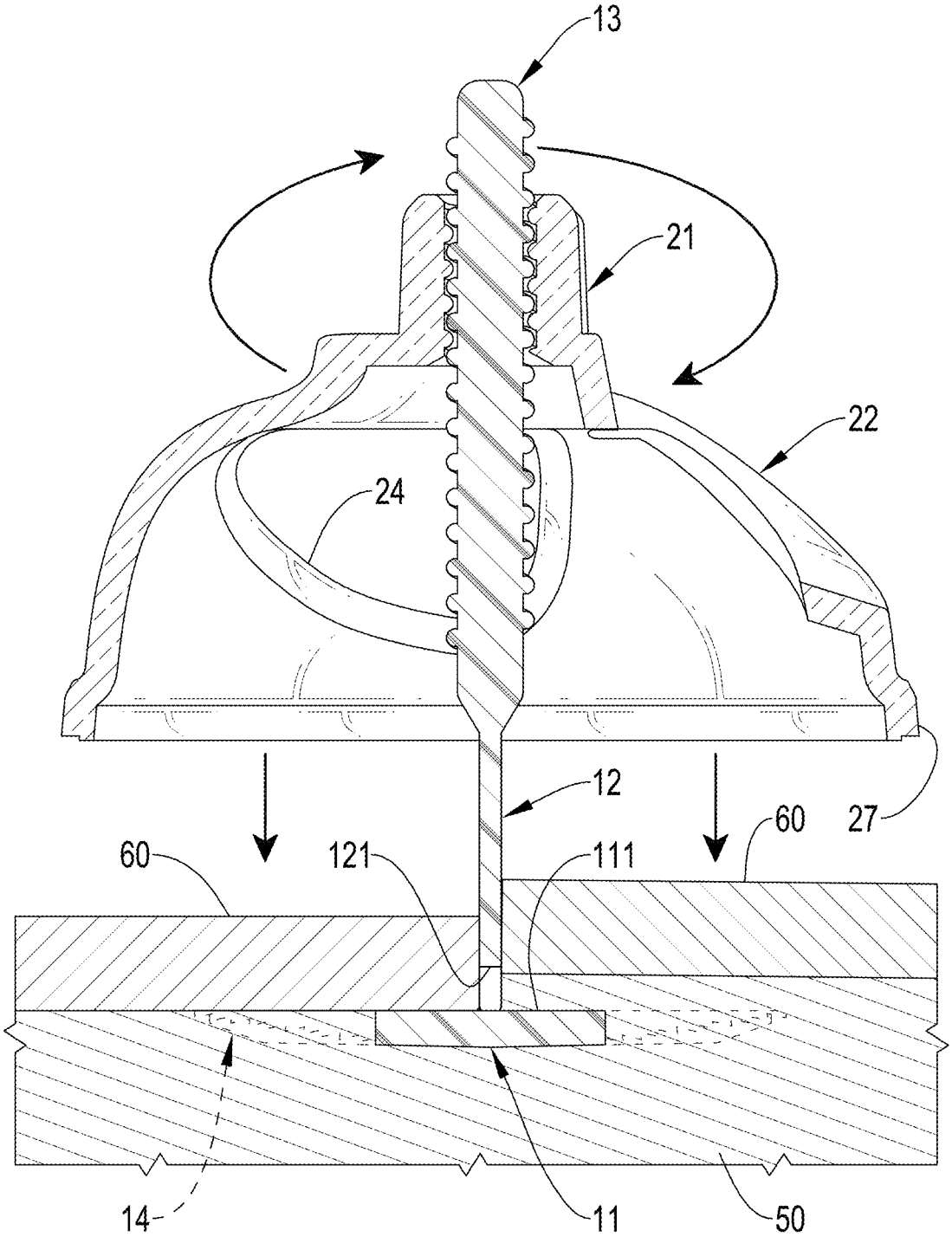
FIGS. 8 and 9 are operational and cross-sectional side views of the tile leveler in FIG. 1, during leveling two adjacent tiles.
Figure 9:
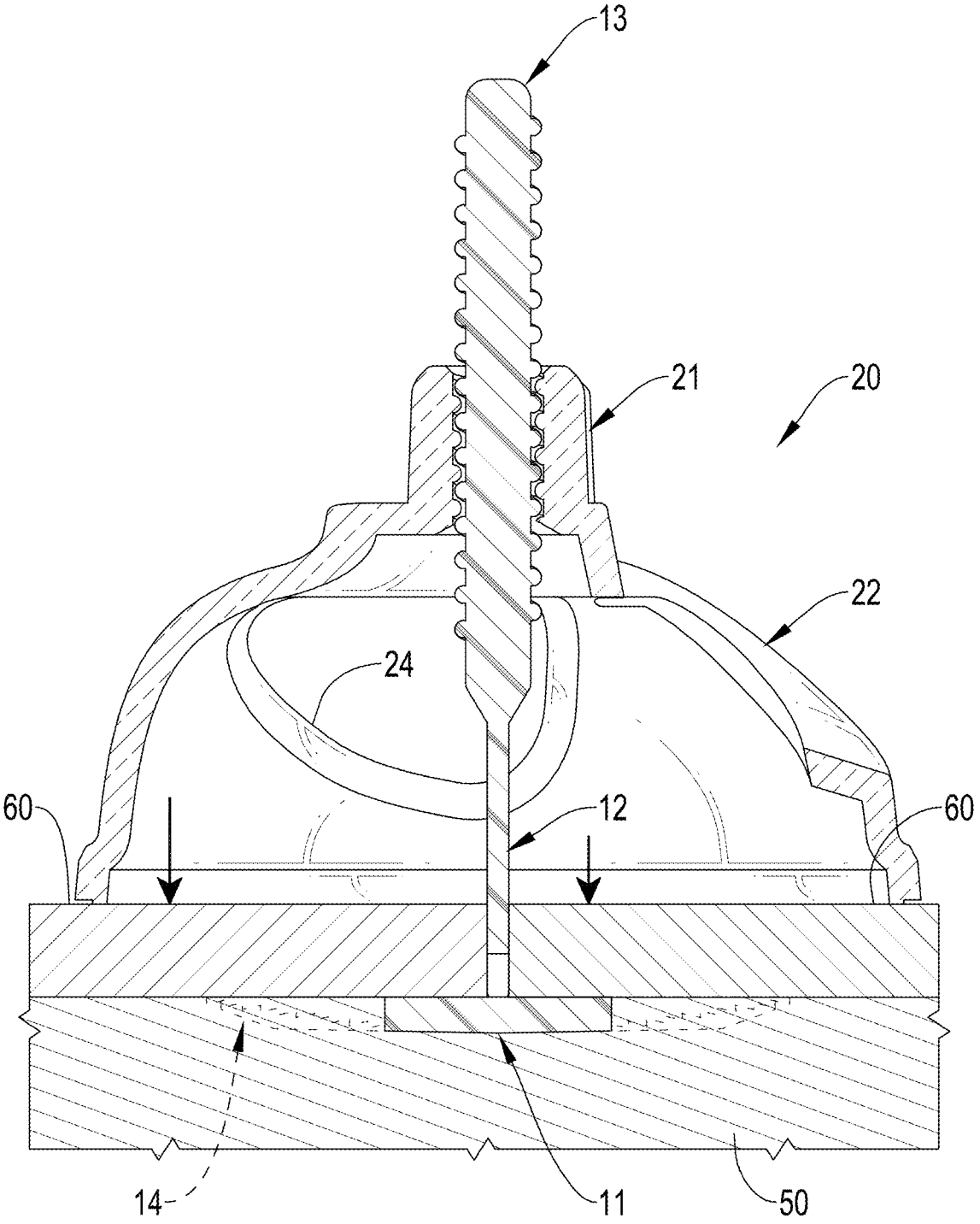
Figure 10:
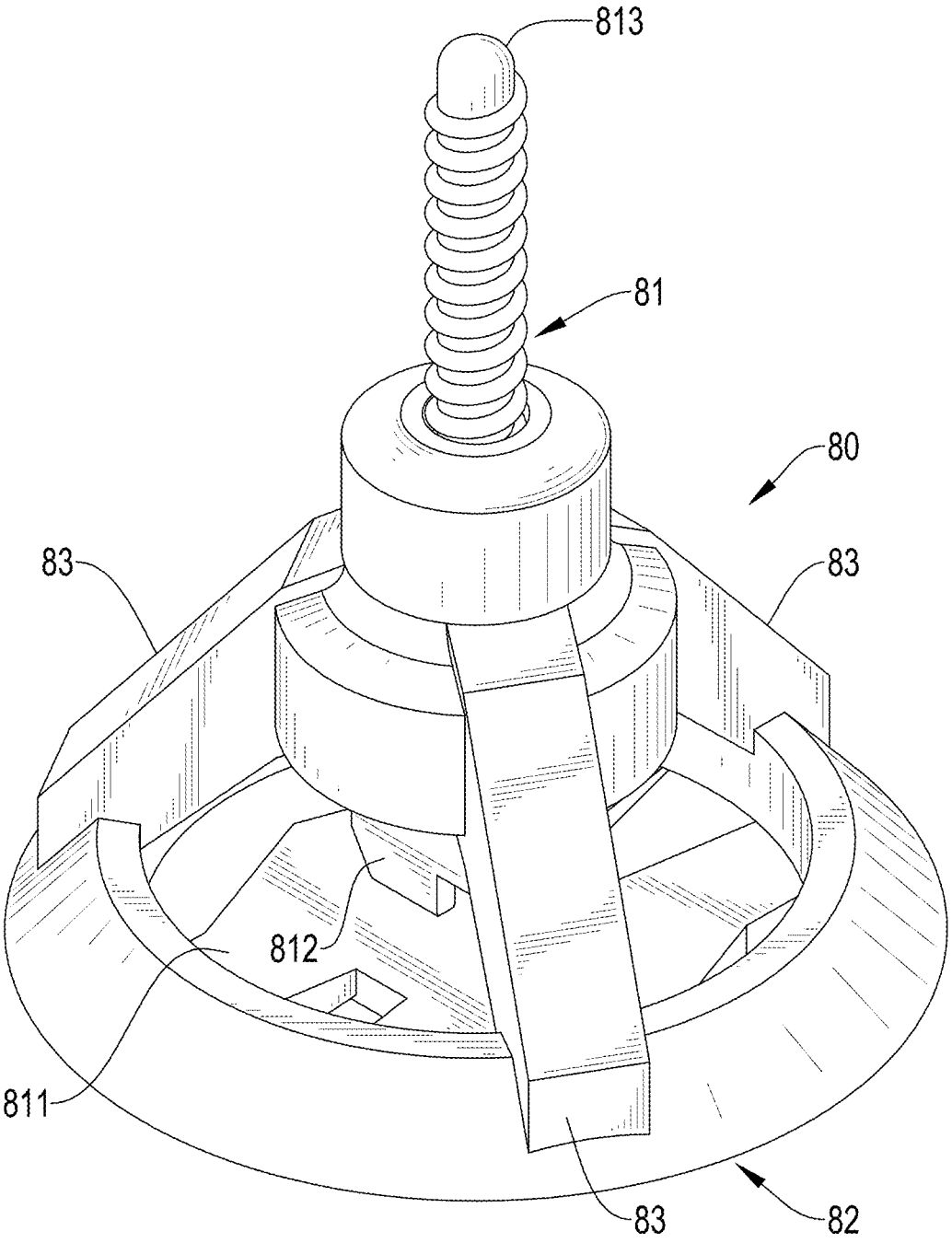
FIG.10 PRIOR ART
FIG. 10 is a perspective view of a leveler in accordance with the prior art.
Figure 11:
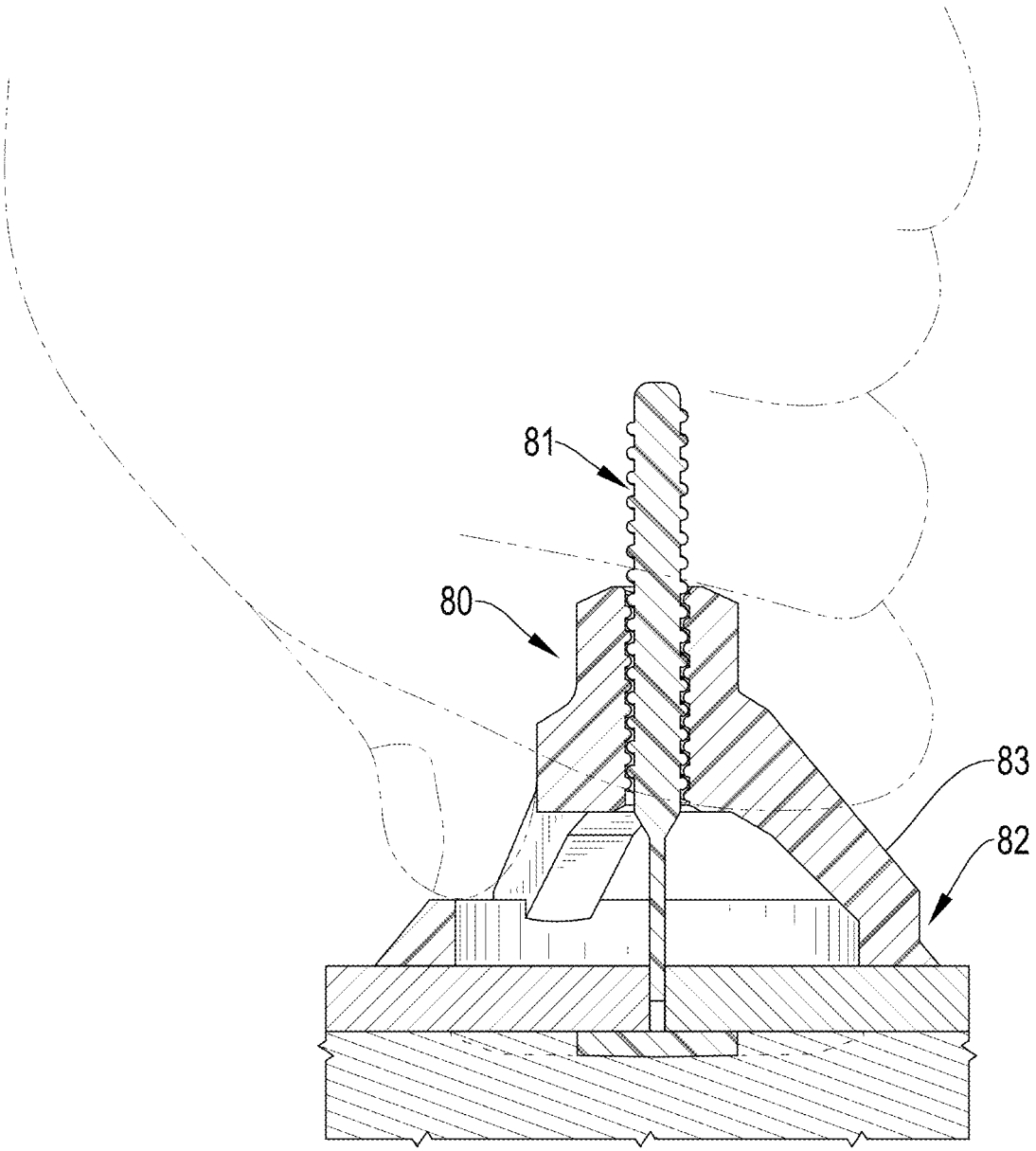
FIG.11 PRIOR ART
FIG. 11 is an operational and cross-sectional side view of the leveler in FIG. 10.

With reference to FIGS. 8 and 9, when using the tile leveler of the present invention for leveling operation, first, the base 10 of the tile leveler is put on a cement 50, a contact area between the clamping board 11 and the cement 50 can be increased by the abutted teeth 141 of each clamping portion 14 of the clamping board 11, and the base 10 can be firmly installed on the cement 50 via the clamping board 11. Then, two tiles 60 are respectively put and arranged on two sides of the connecting slice 12 to enable bottom surfaces of the two tiles 60 to contact the clamping face 111 of the clamping board 11, and the screw portion 21 of the spin cover 20 is connected to the connecting rod 13. With reference to FIG. 6, fingers 40 of a user abut the rotating strips 23 to rotate the spin cover 20 relative to the base 10 and to move toward the two tiles 60 to enable the pressing flange 27 to press against top surfaces of the two tiles 60. At this time, the two tiles 60 will be clamped between the clamping board 11 of the base 10 and the pressing flange 27 of the spin cover 20, thereby providing a leveling effect to the two tiles 60. Furthermore, the user can directly observe the flatness of the two tiles 60 via the light-transmissive spin cover 20, thereby providing a convenient effect of observing the flatness of the tiles 60.

According to the above-mentioned structural relationships and features of the tile leveler of the present invention, the structure of the light-transmissive spin cover 20 allows the user to directly observe the leveling status of the two adjacent tiles 60 during the rotation of the spin cover 20 without blocking by the spin cover 20, and the user does not need to observe the flatness of the two adjacent tiles 60 via intervals between the rotating strips 23. Then the user can conveniently and quickly perform leveling operations on the two adjacent tiles 60. In addition, the at least one rotating strip 23 with the abutted-curved face 231 disposed on the spin cover 20 allows the user to hold the spin cover 20 to rotate relative to the base 10 and allows the fingers 40 of the user to firmly abut against the spin cover 20. Then the spin cover 20 can be held firmly and stably without applying additional force and can be rotated relative to the base 10 conveniently and is labor-saving in use. Furthermore, the structural arrangement of each rotating strip 23 extended curvedly, each abutted-curved faces 231 being an arc face, and each auxiliary contact surface 25 disposed on the outer periphery of the non-circular abutted hole 24 makes the spin cover 20 ergonomic, and allows the user's fingers 40 to hold the spin cover 20 with a comfortable angle for rotation, thereby providing a labor-saving rotation effect.

Even though numerous characteristics and advantages of the present invention have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tile leveler comprising:

a base having a clamping board having:

a clamping face disposed on a top side of the clamping board;

two clamping portions disposed on each one of two ends of the clamping board, and each one of the two clamping portions having multiple abutted teeth arranged in an inclined, stepped manner on a bottom surface of the respective clamping portion; and a gap formed between the two clamping portions on each one of the two ends of the clamping board and gradually expanding from an inside to an outside;

a connecting rod; and a connecting slice connected to the clamping board and the connecting rod; and a spin cover detachably connected to the base, being a transparent cover, and having a screw portion disposed on a top of the spin cover and connected to the connecting rod of the base; and a spin portion connected to the screw portion and having three rotating strips;

wherein each one of the three rotating strips has an abutted-curved face disposed on an outer side of the rotating strip away from the screw portion; and each two adjacent ones of the three rotating strips are arranged on the spin portion at an included angle of 120 degrees.

2. The tile leveler as claimed in claim 1, wherein the spin portion has an opening formed on a bottom of the spin portion; and each one of the three rotating strips is disposed curvedly on and extends out of an external surface of the spin portion along a direction from the screw portion to the opening.

3. The tile leveler as claimed in claim 2, wherein each one of the three rotating strips has two ends, one of the two ends of each rotating strip is connected to the screw portion, and the other one of the two ends of each rotating strip extends radially toward the opening.

4. The tile leveler as claimed in claim 3, wherein the spin cover has an abutted hole formed through an external surface of the spin cover between each two adjacent ones of the three rotating strips; and an auxiliary contact surface disposed between an outer periphery of each abutted hole and each two adjacent ones of the three rotating strips.

5. The tile leveler as claimed in claim 4, wherein each abutted hole is a non-circular structure; and each auxiliary contact surface is connected to the abutted-curved face of one of the two adjacent ones of the three rotating strips.

6. The tile leveler as claimed in claim 5, wherein the spin cover has a reminder symbol disposed on at least one of the auxiliary contact surfaces.

7. The tile leveler as claimed in claim 1, wherein the spin cover has a pressing flange annularly formed on a bottom of the spin portion.

8. The tile leveler as claimed in claim 2, wherein the spin cover has a pressing flange annularly formed on a bottom of the spin portion.

9. The tile leveler as claimed in claim 3, wherein the spin cover has a pressing flange annularly formed on a bottom of the spin portion.

10. The tile leveler as claimed in claim 4, wherein the spin cover has a pressing flange annularly formed on a bottom of the spin portion.

11. The tile leveler as claimed in claim 1, wherein the connecting slice is connected to the clamping face of the clamping board and has a through hole formed through the connecting slice between the clamping board and the connecting slice.

12. The tile leveler as claimed in claim 2, wherein the connecting slice is connected to the clamping face of the clamping board and has a through hole formed through the connecting slice between the clamping board and the connecting slice.

13. The tile leveler as claimed in claim 3, wherein the connecting slice is connected to the clamping face of the clamping board and has a through hole formed through the connecting slice between the clamping board and the connecting slice.

14. The tile leveler as claimed in claim 11, wherein the connecting rod is connected to an edge of the connecting slice away from the clamping board and has a thread formed on an external surface of the connecting rod; and the screw portion has a threaded hole formed through the screw portion and selectively screwed with the thread of the connecting rod.

15. The tile leveler as claimed in claim 12, wherein the connecting rod is connected to an edge of the connecting slice away from the clamping board and has a thread formed on an external surface of the connecting rod; and the screw portion has a threaded hole formed through the screw portion and selectively screwed with the thread of the connecting rod.

16. The tile leveler as claimed in claim 13, wherein the connecting rod is connected to an edge of the connecting slice away from the clamping board and has a thread formed on an external surface of the connecting rod; and the screw portion has a threaded hole formed through the screw portion and selectively screwed with the thread of the connecting rod.

* * * * *